United States Patent [19]

Caldwell

[11] 4,232,896

[45] Nov. 11, 1980

[54] PORTABLE AND COLLAPSIBLE SEAT

[75] Inventor: Lloyd Caldwell, Choteau, Okla.

[73] Assignee: Lloyd Caldwell, Choteau, Okla.

[21] Appl. No.: 63,990

[22] Filed: Aug. 6, 1979

[51] Int. Cl.[3] ..... A47C 1/00

[52] U.S. Cl. ..... 297/4; 108/115; 108/150

[58] Field of Search ..... 297/4; 108/115, 150, 108/43; 248/156

[56] References Cited

U.S. PATENT DOCUMENTS

| | | | |
|---|---|---|---|
| 3,895,839 | 7/1975 | Amato | 297/4 |
| 3,985,387 | 10/1976 | Rischar | 297/4 |
| 4,098,478 | 7/1978 | Spitzke | 108/115 |
| 4,101,163 | 7/1978 | Morin | 297/4 |

*Primary Examiner*—Francis K. Zugel

*Attorney, Agent, or Firm*—William S. Dorman

[57] ABSTRACT

A portable and collapsible seat which can be suspended on a flexible strap from the belt of a user including a rectangular base which ultimately constitutes the seat, a pair of spaced parallel flanges extending outwardly perpendicular to the base along the long edges of the base, a leg somewhat longer than the base itself pivotally and slidably connected to the base, the leg adapted to lie against the base in the collapsed condition of the seat and extending at right angles to the base or seat when the same is in the operable condition, a V-shaped link having a flattened portion adjacent its center and being curved at its ends, the flattened portion of the link being received in a hole in the leg between the ends of the leg, the curved ends of the link being received in openings in the flanges adjacent one end of the base, a clamp being provided at this one end of the base and formed by extensions of the flanges for holding the leg in the collapsed condition of the seat, a clip pivotally connected to the leg adjacent the other end of the base when the leg is in the collapsed condition, the clip being of a width slightly less than the width of the base, a flexible strap having a width slightly less than the width of the base and having one end connected to the clip, the belt extending from the clip along the surface of the base between the leg and the base and terminating at its other end in a loop which is received over the belt of the user, a pair of flat strips extending inwardly towards each other at right angles to the flanges and overlying the strap in parallel relation to the base so as to form a track for the clip and the belt when the leg is pivoted outwardly away from the base.

4 Claims, 5 Drawing Figures

PORTABLE AND COLLAPSIBLE SEAT

BACKGROUND OF THE INVENTION

1. Field of the Invention

The present invention relates to a portable and collapsible seat and, more particularly, to a portable and collapsible seat which can be simply and easily worn by suspending the same on a strap attached to the belt of a user or wearer.

2. Background of the Invention

There are many occasions, particularly when a person is outdoors at a gathering or sports event, where the person would like to sit down but there are no seating places available. It has been proposed in the past to provide portable and collapsible seats which people can carry to sporting events and other activities, but most of these prior art portable seats are somewhat clumsy to carry around. Therefore, it is a principal object of the present invention to provide a portable and collapsible seat which is truly portable and which causes relatively little inconvenience because of its size and weight and because of the manner in which it can be easily attached to the belt of the wearer or user.

3. Summary of the Invention

The present invention relates to a collapsible and portable seat formed by an elongated base which is substantially channel-shaped in cross section, and a leg which is pivotally attached to the base. The leg is movable to two relatively different positions; one position, representing the collapsed position of the seat where the leg is resting against the base; the second position, which repesents the operable condition of the device, is where the leg is at right angles to the base. More particularly, the base itself is a substantially flat, elongated and rectangular member having a pair of flanges extending for the full length of the base and projecting outwardly from the longitudinal edges of base at right angles thereto and parallel to each other. The leg is pivotally attached to the base by the means of a V-shaped link which has a relatively short straight portion at the center of the V, this short straight portion being received in a hole intermediate the ends of the leg. The ends of the link are curved and are received in a pair of opposed holes in the flanges adjacent one end of the base. This same end of the base is provided with a clamp which is formed by extensions of the flanges and which serves to hold the leg in position in the collapsed condition of the seat. A strap extends along the surface of the base between the base and the leg when the latter is in the collapsed condition. One end of this strap connects with a clip which is pivotally connected to one end of the leg adjacent the opposite end of the base. A pair of flat strips are disposed at right angles to the flanges adjacent the opposite end of the base and extend inwardly parallel to the base so as to provide a track for the movement of the clip and the connected end of the strap when the leg is being pivoted outwardly to its operable condition. The clip and the strap are somewhat less in width than the width of the base itself. The ends of the strips at the opposite end of the base are bent or tapered outwardly away from the base to form a guide to assist the clip and the connected end of the strap in entering the track section provided by these strips when the leg is first moved away from its collapsed position. The end of the leg (opposite from the clip) which contacts the ground is provided with a resilient bumper to prevent slipping on a relatively smooth surface. The opposite end of the leg is provided with a rounded projection which fits into a corresponding rounded recess in the base when the leg is positioned at right angles to the base. The end of the strap opposite from the clip is provided with a loop which is adapted to be received around the belt of the wearer. Thus, in the collapsed condition of the seat, it may be simply and casually worn by the user; since the seat can be made of plastic or aluminum, obviously the same can be of extremely light weight and can be carried by the wearer or user with little inconvenience. When it is desired to use the device of the present invention, the user merely grasps the end of the leg which has the bumper thereon, pulls it outwardly away from the clamp at which time the strap commences to exert an upward force on the clip and the adjacent end of the leg, causing the clip to slide upwardly in the track provided by the strips. The clip and associated end of the leg will continue to move upwardly until the rounded projection on the end of the leg is received within the complementary recess in the base. Now the wearer or user simply bends his knees and crouches somewhat backwardly while simultaneously tucking the seat under his posterior until the leg comes to contact with ground and the user's posterior comes to rest on the base.

DETAILED DESCRIPTION OF THE PREFERRED EMBODIMENTS

Figure 1:
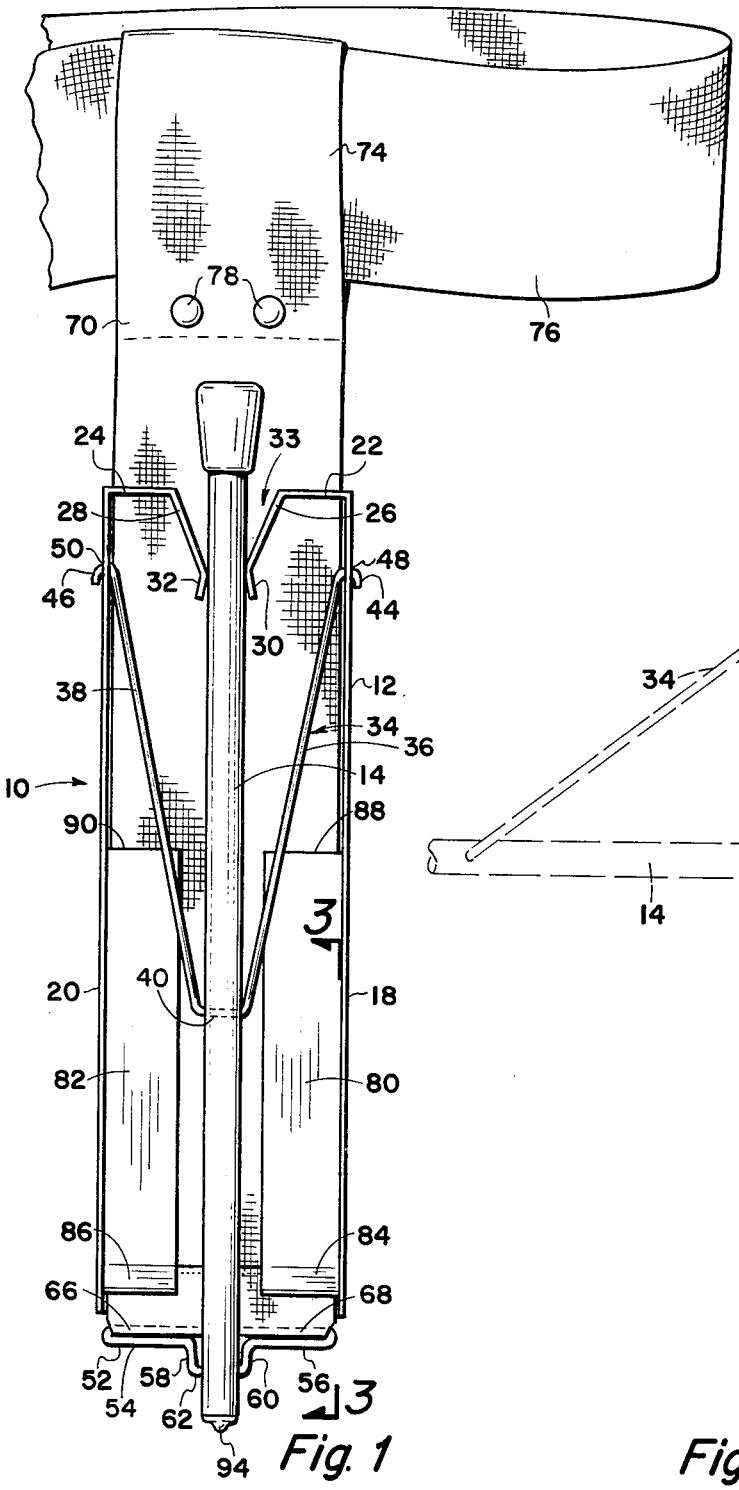
FIG. 1 is a front elevation of the portable and folding seat of the present invention showing the leg folded against the seat portion.
Figure 2:
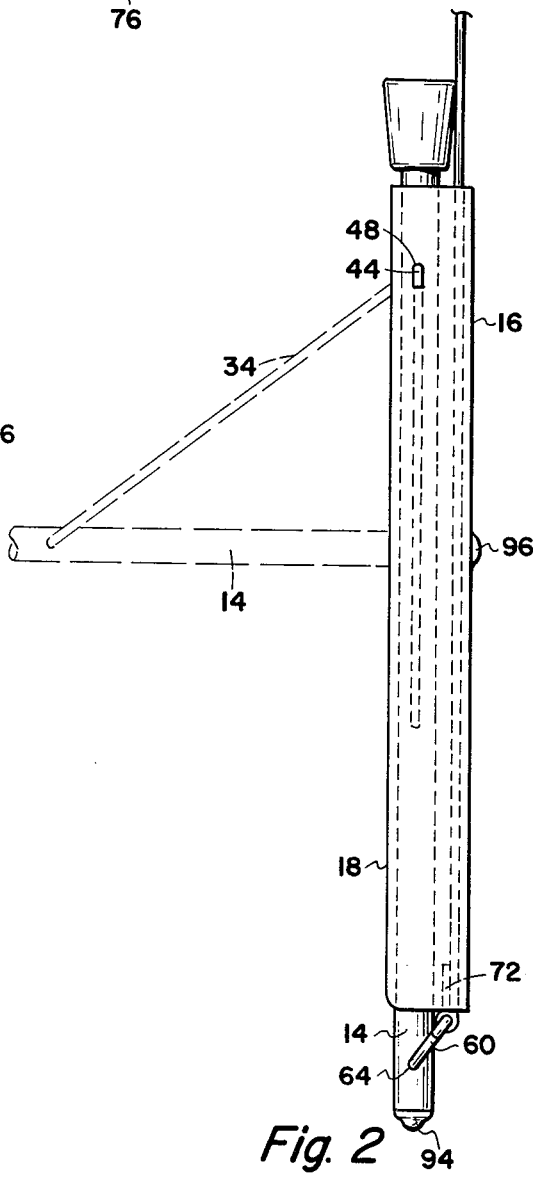
FIG. 2 is a right-hand end view taken from FIG. 1 with certain of the hidden parts shown in dotted lines and further showing, in dashed lines, the unfolded or open position of the leg.
Figures 3, 4, 5:
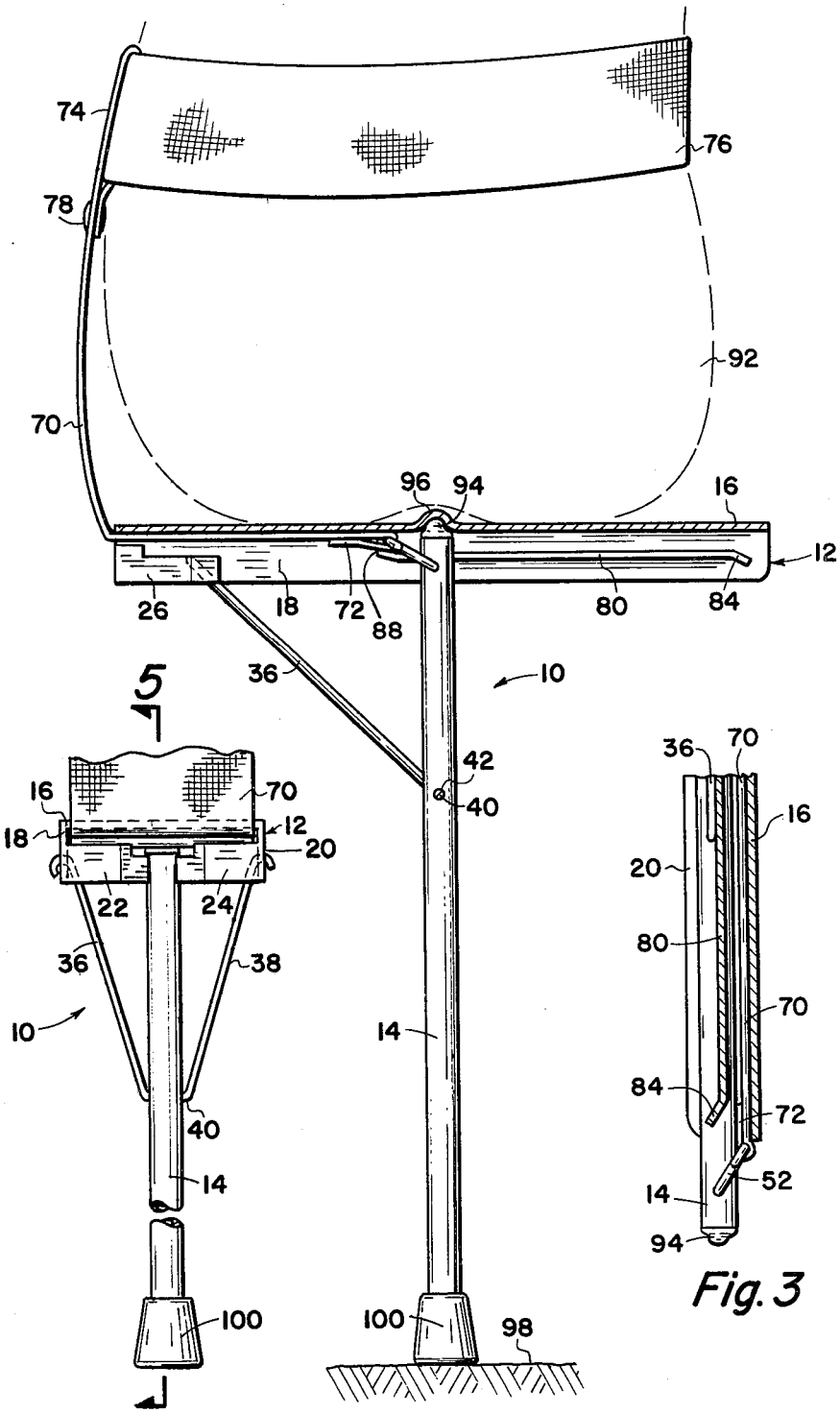
FIG. 3 is a cross sectional view taken along section line 3—3 of FIG. 1.
FIG. 4 is an end elevation showing the portable and collapsible seat in its fully open or operative position.
FIG. 5 is a sectional view, on an enlarged scale, taken along section 5—5 of FIG. 4.

Referring to the drawings in detail, FIGS. 1 and 2 show a portable and collapsible (foldable) seat generally designated by the reference numeral 10 and comprising a substantially flat, elongated and channelshaped seat portion 12 and a leg 14 which is attached to the seat portion 12 and foldable into two relatively different positions with respect to the seat portion. The first position, as will be explained hereinafter in greater detail, is shown in FIGS. 1 and 2 where the leg 14 is folded substantially flat against the seat portion 12; the second position is shown in FIGS. 4 and 5 where the leg 14 is at right angles to the seat portion 12, as will also be explained hereinafter.

The seat portion 12 can be further defined as having an elongated flat base 16 and a pair of elongated sides or flanges 18 and 20 extending for substantially the full length of the base 16 and at right angles thereto. With reference to FIG. 1, the upper ends of the side members 18 and 20 are provided with integral extensions 22 and 24 which extend at right angles to the sides 18 and 20, respectively, and with further integral extensions 26 and 28 which extend convergently downwardly from the members 22 and 24 respectively, and a final pair of integral extensions 30 and 32 which extend slightly divergently outwardly from the lower ends of the extensions 26 and 28, respectively. The extended ends of the side members 18 and 20, as described above, which include the portions 22 through 32, inclusive, form a latch or holding means 33 for securing the leg 14 in its retracted position as shown in FIG. 1.

A V-shaped link 34 is provided having elongated arms 36 and 38 connected together by a short cross piece 40 at the center of the "V." The link 34 extends through the leg 14 such that the cross member 40 is received in an opening or hole 42 which extends through the leg 14. The outer or upper ends of the arms 36 and 38 are bent at 44 and 46 and are received in suitable openings 48 and 50 in the side members 18 and 20, respectively.

The lower end of the leg 14 connects with a pivotal clip 52. This clip 52 is formed from a piece of bent wire, for example, which is bent in such manner as to provide a pair of arms 54 and 56 which extend outwardly from the leg 14 a distance slightly less than the distance between the sides 18 and 20 of the seat 12. The inner ends of the arms 54 and 56 connect with a pair of right angled portions 58 and 60, and these members, in turn, connect with a short straight piece 62 which is received in an opening 64 adjacent the lower end of the leg 14. The outer ends of the arms 52 and 56 are each bent at 180° to form another pair of arms 66 and 68 which extend inwardly towards each other parallel to the arms 52 and 56. The lower end of a strap 70 is received in the space between the arms 66 and 68 and the arms 52 and 56. The lower end of the strap 70 is bent over as at 72 around the arms 66 and 68 and the folded end 72 is secured to the main body of the strap 70 by stitching, adhesive or in any other suitable manner. In the position shown in FIGS. 1 and 2 the strap 70 extends along the inner surface of the base 16 and adjacent thereto. The upper end of the strap 70 can be folded over as shown so as to provide a loop 74 through which a belt 76 can pass. The belt 76 can be provided with the device of the present invention or it could be the conventional belt normally worn by the user of the present invention. The loop 74 on the strap 70 can be secured to the strap by means of a clasp 78, if desired.

The seat 12 is further provided with a pair of integral and inwardly extending flat strips 80 and 82 which are disposed at right angles to the sides 18 and 20 and which are parallel to the base 16 of the seat. These strips 80 and 82 constitute tracks for guiding the movement of the clip 52 and the folded end 72 of the strap 70 when the latter assist the leg 14 in moving to its open position, as will be explained hereinafter. The outermost ends of the tracks 80 and 82 are bent downwardly (away from the base 16) as at 84 and 86 so as to form tapered guides for the entry of the clip 52 into the space between the guides 80 and 82 and the base 16 when the leg 14 is moved to its open position, as will be explained hereinafter. The inner ends of the strips or tracks 80 and 82 are bent, as at 88 and 90, upwardly towards the base 16 so as to provide stops for the clip 52 and the folded end 72 of the strap 70 when the leg 14 is in its fully open position as shown in FIG. 5.

When the seat is in the retracted position as shown in FIG. 1, it can be easily and casually worn at the side of a wearer 92 (see FIG. 5). In such a case, the device 10 will merely hang from the strap 70 along the upper portion of the leg of the wearer. When it is desired to utilize the device 10 of the present invention, the leg 14 is pulled out of the latch 33 while the strap 70 simultaneously exerts an upward force on the clip 52 to move the leg 14 to the dashed line position shown in FIG. 2 and the solid line position shown in FIG. 5. The lower end (as it appears in FIG. 1, or the upper end as it appears in FIG. 5) of the leg 14 is provided with a rounded projection 94 which is adapted to be received in a rounded dimple or recess 96 in the base 16 in the fully opened position of the device 10 as shown in FIG. 5. When the leg 14 has been moved to the fully extended position shown in FIG. 5, the wearer of the device 10 will bend his knees and crouch slightly while tucking the device 10 under his posterior with the strap 70 extending from the belt 76 downwardly around one side of his posterior to achieve the condition shown in FIG. 5. Thus, the device 10 provides a seat for a person who might otherwise be tired from standing too long at an outdoors event, such as a golf tournament, and wishes to rest temporarily on such a seat as provided by the present invention. In order to prevent the lower end of the leg 14, in extended position, from sliding on the surface of the ground 98 (or other surface), a rubber bumper on knob 100 is attached to the lower end of the leg 14.

Summarizing, the drawings disclose a portable and collapsible seat which, in the collapsed or folded condition, is adapted to hang from a strap suspended from the belt of a wearer so as to lie against the side of the leg of a wearer. This portable seat can be made of aluminum or plastic so as to be relatively light weight in construction thereby affording little or no inconvenience to the wearer when walking around, for example, at a golf tournament or the like, with the portable seat hanging at the side. When the wearer of the portable seat wishes to use the same, he merely grasps the top of the leg adjacent the bumper and pulls the leg outwardly away from the clamp, at which time the seat portion slides downwardly with respect to the strap causing the leg to pivot about the link and simultaneously to slide, adjacent the other end of the leg, along the track provided in the seat and which is capable of accommodating the clip and the end of the strap which is fastened to the clip. When the leg reaches a right angled position with respect to the base, a projection on the end of the leg is received in a recess in the base so as to secure the leg in its right angled position relative to the base. The wearer or user can now simply commence to crouch while simultaneously tucking the seat under his posterior until he assumes the position shown in FIG. 5. The bumper or protector which is fastened to the lower end of the leg can be made of rubber or plastic or other resilient material and will prevent the leg from slipping on a smooth surface.

Whereas the present invention has been described in particular relation to the drawings attached hereto, it should be understood that other and further modifications, apart from those shown or suggested herein, may be made within the spirit and scope of the invention.

What is claimed is:

1. A portable and collapsible seat adapted to be suspended from the belt of a user comprising a substantially flat and elongated base in the shape of a rectangle formed by a pair of relatively long parallel side edges connected at their ends to a pair of relatively short parallel end edges perpendicular to the long edges, a pair of elongated flanges extending outwardly from one side of said base at right angles thereto and along the long side edges thereof, a leg extending from a first end thereof to a second end thereof and having a length greater than the length of said base, a V-shaped link having a flattened portion adjacent its center and being curved at its ends, the flattened portion of said link being received in a hole said leg intermediate the ends thereof, the curved ends of said link being received in openings in said elongated flanges adjacent one end of said base, said flanges being provided with extensions at said one end of said base being bent inwardly away from said one end and towards the longitudinal center of said base to provide a clamp for the first end of said leg when said leg is positioned to lie against said base, a clip pivotally connected to said leg adjacent said second end of said leg, said clip having a pair of arms extending outwardly at right angles to said leg on opposite sides thereof and for a distance slightly less than the width of said base, a flexible strap having a width slightly less than the width of said base and having one end connected to the arms of said clip, said belt extending from said one end thereof along the surface of said base between the said leg and said base and terminating at an end opposite from one said end thereof in a loop adapted to be received on said belt of said user, said clip and said one end of said strap lying closely adjacent the end of said base opposite from said one end thereof when said leg is positioned to lie against said base, a pair of flat strips extending inwardly towards each other at right angles to said flanges and overlying said strap in parallel relation to said base so as to form a track for said clip and said one end of said belt when said leg is pivoted outwardly away from said base, whereby, said first end of said leg is first pivoted away from said one end of said base and out of said clamp and, whereby subsequent movement of said strap and said clip in a direction from the opposite end of said base towards said one end thereof will cause said leg to pivot around said link relative to said base until said leg is substantially perpendicular to said base.

2. A portable and collapsible seat as set forth in claim 1 wherein said second end of said leg is provided with a rounded projection, and wherein said base is provided with a rounded recess positioned to receive the rounded projection on said leg when said leg is at right angles to said base.

3. A portable and collapsible seat as set forth in claim 2 wherein said flat strips are inclined outwardly at their ends away from said base to form tapered guides for the entry of said clip and said one end of said strip into the spaces between said strips and said base.

4. A portable and collapsible seat according to claim 3 wherein a flexible bumper is provided on the first end of said leg.

* * * * *